United States Patent [19]

Rathmayr

[11] Patent Number: 4,907,559

[45] Date of Patent: Mar. 13, 1990

[54] PUMP NOZZLE FOR DIESEL ENGINES

[75] Inventor: Heinz Rathmayr, Hallein, Austria

[73] Assignee: Voest-Alpine Automotive Gesellschaft m.b.H., Linz, Austria

[21] Appl. No.: 332,607

[22] Filed: Apr. 3, 1989

[30] Foreign Application Priority Data

Apr. 8, 1988 [DE] Fed. Rep. of Germany ..... 3811845

[51] Int. Cl.[4] ..... F02M 39/00

[52] U.S. Cl. ..... 123/500; 123/446

[58] Field of Search ..... 123/500, 501, 446, 447, 123/496, 503; 239/88–96

[56] References Cited

U.S. PATENT DOCUMENTS

| | | | |
|---|---|---|---|
| Re. 30,189 | 1/1980 | Perr | 123/501 |
| 2,147,390 | 2/1939 | Vaudet | 123/501 |
| 3,999,529 | 12/1976 | Davis | 123/500 |
| 4,146,178 | 3/1979 | Bailey | 123/500 |
| 4,630,586 | 12/1986 | Guntert | 123/500 |
| 4,705,005 | 11/1987 | Guntert | 123/500 |
| 4,708,114 | 11/1987 | Guntert | 123/500 |
| 4,836,170 | 6/1989 | Hafele | 123/501 |
| 4,840,161 | 6/1989 | Eckell | 123/500 |

FOREIGN PATENT DOCUMENTS

| | | | |
|---|---|---|---|
| 3143073 | 5/1983 | Fed. Rep. of Germany | 123/501 |
| 0164773 | 12/1980 | Japan | 123/500 |
| 2094901 | 9/1982 | United Kingdom | 123/500 |

*Primary Examiner*—Carl Stuart Miller

*Attorney, Agent, or Firm*—Cushman, Darby & Cushman

[57] ABSTRACT

In a pump nozzle for Diesel engines, in which an injection pump element comprising a pump piston (1) driven by a cam shaft and a pump element bushing (11) is combined with an injection nozzle (8) to form a unit associated to one motor cylinder each, the pump piston (1) is surrounded by a control sleeve (12) which can, for the purpose of varying the begin of fuel injection, be shifted in direction of the axis of the pump piston (1) in dependence on operating parameters of the motor, noting that the pump piston (1) is rotatable relative to the control sleeve (12) for the purpose of adjusting the supplied amount of fuel. The control sleeve (12) is connected with a separating sleeve (17) surrounding said control sleeve (12) and being guided at both sides of the control sleeve (12) with its inner side for being axially shiftable on the pump element bushing (11). The separating sleeve (17) has at its end located opposite the injection nozzle (8) a hook-like protrusion (21) sensing a surface (23) extending in transverse relation to the axis and being inclined relative to a normal plane extending in normal relation to the axis and being shiftable in parallel relating to this normal plane in direction of its inclination, noting that the adjusting force causing the axial adjusting movement of the control sleeve (12) acts on the inclined surface (23) and shifts same in the direction of its inclination.

17 Claims, 12 Drawing Sheets

PUMP NOZZLE FOR DIESEL ENGINES

BACKGROUND OF THE INVENTION

1. Field of the Invention

The invention refers to a pump nozzle for Diesel engines, in which an injection pump element comprising a pump piston driven by a cam-shaft and a pump element bushing is combined with an injection nozzle to a unit to be associated to one motor cylinder each, wherein the pump piston is surrounded by a control sleeve being non-rotatable relative to the pump element bushing and being adjustable in direction of the axis of the pump piston in dependence on operating parameters of the motor for the purpose of varying the beginning of the injection and wherein the pump piston can be rotated relative to the control sleeve for the purpose of adjusting the supplied fuel amount. Such a control sleeve has, as a rule, a control edge located within a plane extending in normal relation to the pump axis and controlling the beginning of fuel injection. An obliquely extending control edge of the control sleeve or of the pump piston defines the end of injection and thus the injected amount of fuel in dependence on the rotated position of the pump piston relative to the control sleeve. By adjusting the height position of the control sleeve, the control edge defining the beginning of injection is earlier or later slid past the control bore of the piston, so that the beginning of supply by the injection pump is adjusted.

2. Description of the Prior Art

From DE-A1-31 43 073 there has become known a pump nozzle of the type in which the control sleeve is axially adjustable for the purpose of adjusting the beginning of injection. In this case, adjusting of the control sleeve is directly effected by means of a hydraulic piston. On account of adjusting the control sleeve directly by means of the hydraulic piston, the adjusting path of the control sleeve is equal the adjusting path of the hydraulic piston. On account of the adjusting path of the control sleeve being small, there are at disposal only small adjusting paths of the hydraulic piston for adjusting the control sleeve, so that such a control is not delicately sensitive and precise. In an embodiment according to the mentioned DE-A, the hydraulic piston is connected with the control sleeve via a linkage. Adjusting of the control sleeve becomes more inprecise on account of the play within the linkage. The control sleeve is immediately guided on the pump piston, so that wear is promoted between control sleeve and pump piston. The control piston is guided on the pump piston over a comparatively small guide length, so that there exists the risk for the control sleeve to become jammed on the pump piston, thereby increasing the wear of pump piston and control sleeve and further reducing the precision of control. In an other embodiment, the axially adjustable hydraulic piston surrounds the pump piston and is itself designed as the control sleeve. Also in this embodiment, the adjusting path of the hydraulic piston is thus equal the adjusting path of the control sleeve and therefore very small, and there are additionally required complicated sealings which equally detract from the precision and the sensitiveness of the control on account of the friction phenomenon.

SUMMARY OF THE INVENTION

It is an object of the invention to provide a pump nozzle in which the beginning of injection can exactly be adjusted in a reproducible manner individually and independent from the other pump nozzles and in which the adjustment made can easily be set without stopping the operation of the test stand or the motor, noting that the adjusting device is also suitable for electronical operation.

For solving this task, the invention essentially consists in that the control sleeve is connected with a separating sleeve surrounding the control sleeve and being non-rotatable and non-shiftable in axial direction relative to the control sleeve, said separating sleeve being at both ends of the control sleeve guided for being axially shiftable on guiding surfaces of the pump element bushing, wherein the pump element bushing comprises a space between the guiding surfaces for receiving the control sleeve, which space also forms the fuel discharge chamber, in that the separating sleeve has at its end located opposite the injection nozzle a hook-like protrusion sensing a surface transversely extending to the axis and being at least partially inclined relative to a plane normal to the axis of the pump piston and being shiftable in parallel relation to said normal plane in direction of its inclination, and in that the adjusting force provoking the axial adjusting movement of the control sleeve acts on said inclined surface. On account of the control sleeve being guided on the bushing of the pump element with interposition of the separating sleeve and on account of this separating sleeve being in its turn again shiftably guided on the bushing at both sides of the control sleeve, there results a great guiding length for the separating sleeve and thus a precise guide of the control sleeve, noting that the guide surfaces are subjected to an only low load and will thus scarcely be subjected to wear. The guide for the control sleeve on the pump piston is thus relieved from load to a great extent, so that any abrasion on the pump piston and on the control sleeve is avoided and the control function is precisely maintained. On account of the separating sleeve having at its end located remote from the injection nozzle a hook-like protrusion for the purpose of effecting the height adjustment of the separating sleeve and thus of the control sleeve, jamming forces acting on the separating sleeve and on the control sleeve are minimized. On account of the hook-like protrusion sensing an inclined surface extending in transverse relation to the axis and being shiftable, a small height adjustment of the control sleeve can be reached by a great shifting movement of this inclined surface. This great transformation makes possible a high precision control. The inclined surface may include with said normal plane an angle of 3° to 22°, i.e. conveniently 3° to 8° in case of a stroke of 15 mm of the hydraulic piston, 4° to 12° in case of a piston stroke of 10 mm and 9° to 22° in case of a piston stroke of 5 mm. On account of the thus provided transformation between the shifting movement of the inclined surface and the lifting movement of the control sleeve, there is made possible a delicately sensible and thus precise adjustment of the beginning of fuel injection. Furthermore, the pump piston and the control sleeve are shielded against the pump spring chamber by means of this separating sleeve, so that any abraded material existing within the pump spring chamber can not enter the control chamber and thus not the gap between pump piston and control sleeve, so that any jamming is avoided. Because the control sleeve is positioned between the guiding places of the separating sleeve on the pump element bushing in a recess of the pump element bushing, the control sleeve and the discharge chamber are shielded completely by the separating sleeve.

According to the invention and in an advantageous manner, the inclined surface can be located above the control sleeve and be shiftable along a straight line, wherein the shifting direction thereof extends tangentially to a circle concentric to the axis of the pump piston. On account of the inclined surface being located above the control sleeve, the control sleeve is pulled during its height adjustment movement, which already counteracts any jamming, and it is obtained the advantage that the adjusting device is easily accessible for effecting setting during operation. According to the invention, the inclined surface can, in a manner known per se, be adjusted by means of a hydraulic piston. According to an advantageous embodiment of the invention, the inclined surface may even be provided on the hydraulic piston itself, thus saving a separate constructional part. For this purpose, the inclined surface may be formed by a chamber of the hydraulic piston and the hydraulic piston itself might be given a conical shape within the area of the inclined surface.

According to the invention, the inclined surface can also be formed by a helical race surrounding concentrically the axis of the pump piston and being rotatable in shifting direction around the axis of the pump piston. Such an arrangement has the advantage that the force acting on the hook becomes effective in proximity of the guide of the separating sleeve and thus any risk of jamming is excluded. In this case and according to the invention, the race forming the inclined surface can be worked on part of the circumference of the mantle of the rotor of an electrical adjusting member. In this manner the precision of adjusting the control sleeve is increased. The control equipment has a reduced inertia behavior and the constructional height of the pump nozzle can also be reduced, because the inclined surface can be designed as a groove within the mantle of the rotor.

According to the invention, the inclined surface may be provided with sections of inclinations of differing degree and/or different directions, said sections being arranged one behind the other in shifting direction. The gradient of the inclined surface may become smaller in different sections and the gradient or angle of inclination can even be zero in one or in more of the sections. In this manner, there is provided an additional possibility to adapt the control of the begin of fuel injection to various requirements.

According to a preferred embodiment of the invention, the control sleeve is supported against a supporting surface of the separating sleeve and is pressed against this supporting surface by at least one compression spring being supported against that end of the bushing of the pump element which is located opposite the injection nozzle. By means of this compression spring any play resulting from tolerance fit is avoided, so that the precision of control is increased. On account of the control sleeve being supported against the separating sleeve, this compression spring simultaneously forms also a return spring pressing the hook-like protrusion against the inclined surface. According to the invention, this compression spring may be located within the return flow chamber. According to an advantageous embodiment of the invention the return flow chamber is separated from the pump suction chamber and is connected with the return conduit via bores. In this manner, the pressure within the return flow chamber may be relieved in an attenuated manner, which results in the advantage that a smaller number of impacts act on the control sleeve and, in continuation, via the separating sleeve and the hook on the inclined surface. Pressure fluctuations are avoided within the pump suction chamber, which results in completely and regularly filling the high pressure chamber and thus in a reproducible fuel supply also in case of a high rotating speed.

According to the invention, the suction chamber can be in connection with the pump spring chamber and the fuel supply to the suction chamber can be effected through the pump spring chamber, noting that one check valve each is arranged in the fuel supply conduit to the pump spring chamber as well as in the fuel return conduit from the suction chamber. The guide bushing results in a dynamic pressure increase of the fuel contained within the pump spring chamber during the working stroke, so that the high pressure chamber of the pump piston becomes better filled during the suction stroke. By means of correspondingly dimensioned valves and throttle areas within the fuel supply conduit and fuel return conduit, setting of the filling pressure can be better defined.

According to the invention, the hydraulic piston is subjected to the action of fuel contained in a pressure-controlled chamber, in which the pressure is controlled in dependence on operating parameters of the motor, for example by a valve controlled by an electronic control unit. The fuel may be fed into this pressure-controlled chamber from the fuel return chamber of the pump or from the pump spring chamber being connected with the suction chamber. In this case it is only essential, that the chamber, from which the fuel is supplied into the pressure-control chamber, is subjected to a pressure being higher than the pressure for which the pressure-controlled chamber shall be adjusted. This condition is met if fuel is supplied to the pressure-controlled chamber from the fuel return chamber of the pump or from the pump spring chamber being in connection with the suction chamber. In this case and according to the invention, the fuel is supplied to the pressure-controlled chamber via a throttle valve or a throttle area. In this manner one can do without a separate pressure generator. The switching valve controlled by an electronic control unit for modifying the pressure level within the pressure-controlled chamber may be incorporated within the housing of the pump nozzle.

A further development of the invention consists in that the pump spring chamber and a chamber housing an electrical control member actuating the crank lever for rotating the pump piston are in communication one with the other and are sealed against the chamber housing the cam-shaft, rocking levers and push rods for the pump drive means and in that a fuel supply conduit is connected to the chamber housing the control member and a fuel return conduit to the reservoir is connected to the pump spring chamber. Therewith the electric windings are cooled by the passing amount of fuel and moreover fuel leaking from the high pressure chamber into the pump spring chamber is discharged without becoming mixed with the motor oil being present within the chamber housing the cam shaft, rocker levers and push rods.

BRIEF DESCRIPTION OF THE DRAWING

In the drawing, the invention is schematically illustrated with reference to examples of embodiment. In the drawing

FIG. 13 is a cross-section along line XIII—XIII of FIG. 12.

DETAILED DESCRIPTION OF THE PREFERRED EMBODIMENT

Figure 1:
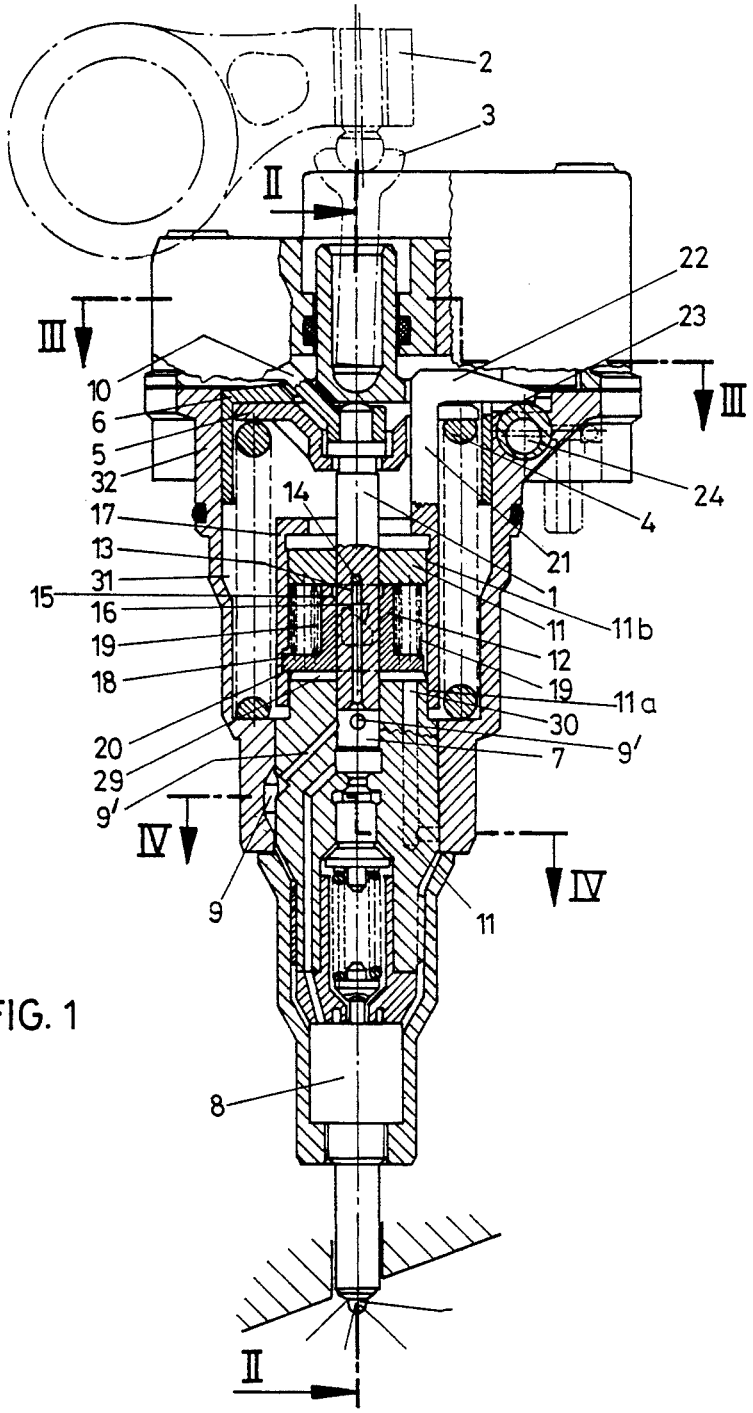
FIGS. 1 to 4 show an embodiment of the pump nozzle, FIG. 1 being a section along line I—I of FIG. 2, FIG. 2 being a section along line II—II of FIG. 1, FIG. 3 being a section along line III—III of FIG. 1 and FIG. 4 being a section along line IV—IV of FIG. 1.
Figure 2:
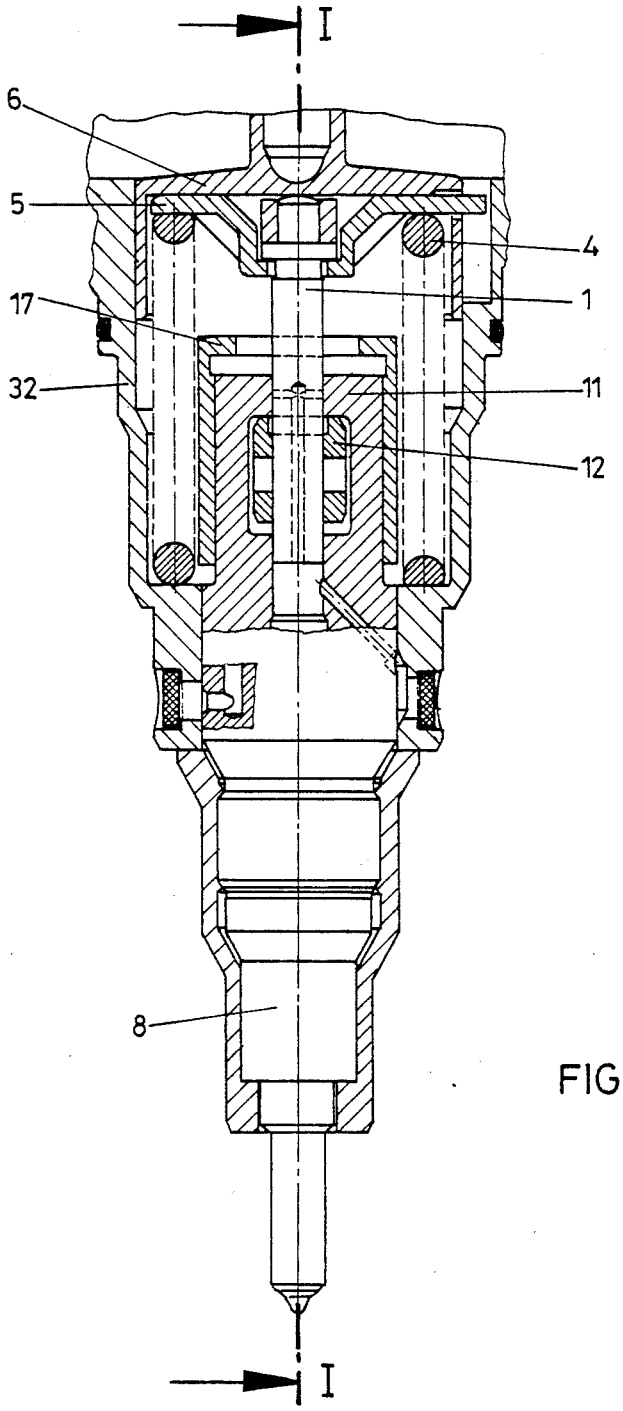

In the example of embodiment according to FIGS. 1 to 4, reference numeral 1 represents the pump piston being driven by a cam-shaft not shown via a rocker lever 2 and a push rod 3. The pump spring 4 acts on the pump piston via a spring washer 5 and is guided within a guide bushing 6. Reference numeral 7 represents the high pressure chamber of the pump and reference numeral 8 represents the injection nozzle. Element 9 is the suction chamber and 9′ is the suction bore. Element 10 is the crank arm for rotating the pump piston. Element 11 is the pump element bushing.

12 is the control sleeve, which surrounds the pump piston 1 and which comprises a control opening limited by an inclined control edge, respectively. Element 15 is a control edge of the control sleeve 12 in a plane normal to the axis. The piston 1 has an axial bore 13 from where extends a radial bore 14. Via this axial bore 13 the radial bore 14 is in open connection with the working chamber of the pump piston 1. As soon as the lower edge 15 during the pressure stroke of the piston 1 closes the radial bore 14, fuel supply is started. As soon as the inclined edge 16 clears the transverse bore 14 of the piston 1, the fuel supply stroke is finished and the fuel is discharged from the high pressure chamber 7.

The control sleeve 12 is connected with a separating sleeve 17 by means of a protrusion 18 engaging a recess of the separating sleeve 17 and is pressed by means of two compression springs 19 against the supporting surface 20 of the separating sleeve 17. In this manner, the control sleeve is connected without any play in height direction with the separating sleeve 17. This separating sleeve 17 is drivingly connected with the control sleeve 12 and is guided with its internal side on the pump element bushing 11 on guiding surfaces 11*a* and 11*b* above and below the control sleeve 12 for being shiftable in height direction, so that the control sleeve 12 is unobjectionably guided without subjecting to stress the pump piston 1 and the internal surface of the control sleeve cooperating with the pump piston 1, so that there results an only low wear.

Figure 12:
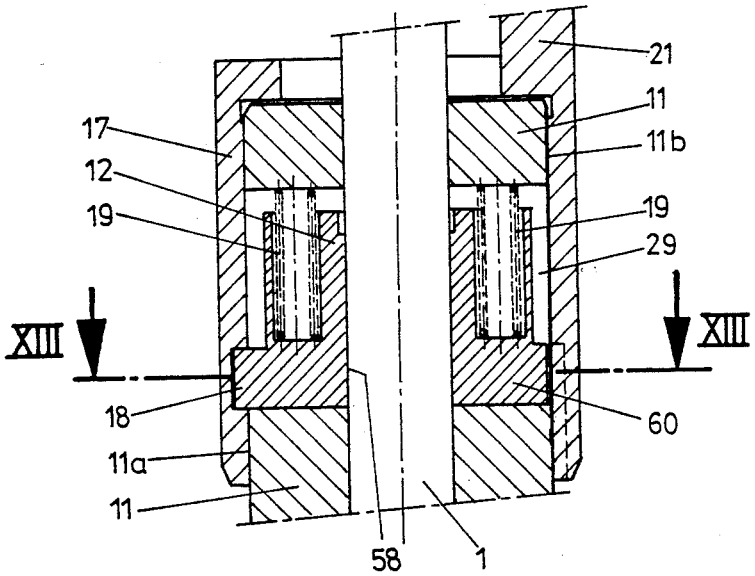
FIGS. 12 and 13 show a detail of the control sleeve and, respectively, of its arrangement in a greater scale, noting that FIG. 12 is an axial section along line XII—XII of FIG. 13
Figure 13:
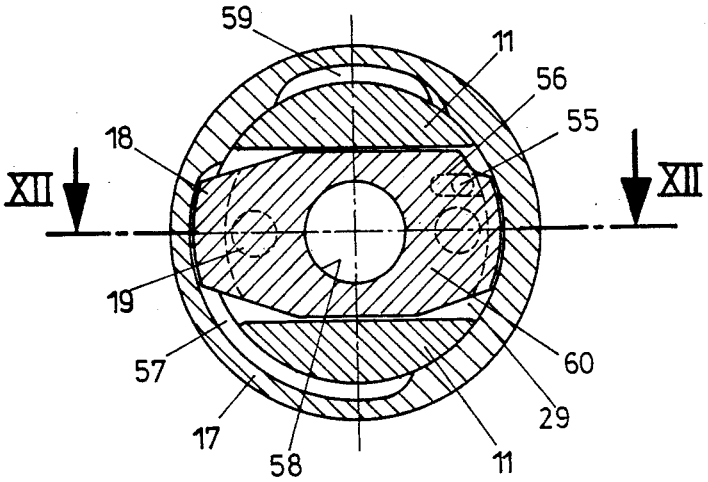

In FIGS. 12 and 13 there is shown in a greater scale and in detail the control sleeve 12 with the separating sleeve. The control sleeve is secured against rotation relative to the pump element bushing 11 by a pin 55 inserted into the pump element bushing 11 and engaging a slot 56 of the control sleeve 12. Because the separating sleeve 17 is also secured against rotation, the control sleeve 12 is thus non-rotatable relative to the separating sleeve 17. The control sleeve 12 is again pressed in downward direction by means of the springs 19, which are supported against the pump element bushing 11. The control sleeve 12 is supported in axial direction against the separating sleeve 17 by the protrusion 18 engaging an annular groove 57, which extends over part of the inner surface of the separating sleeve 17. Between the guiding surfaces 11*a* and 11*b* the pump element bushing 11 comprises a chamber 29 for receiving the control sleeve, which chamber simultaneously forms the discharge chamber.

Figure 14:
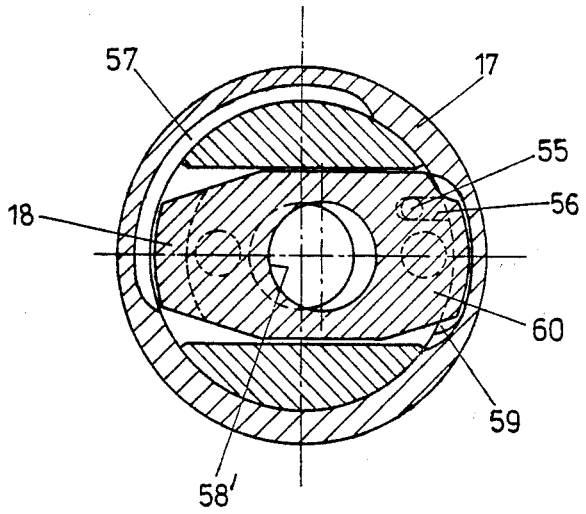
FIG. 14 shows in a section corresponding to line XIII—XIII of FIG. 12 the manner of mounting the control sleeve within the separating sleeve.

In FIG. 14 there is shown how the control sleeve 12 is mounted into the separating sleeve 17. With the 10 piston 1 being extracted, the control sleeve 12 is shifted in right hand direction relative to the separating sleeve 17, so that the bore 58 of the control sleeve 12, in which the pump piston 1 is guided, assumes the relative position 58′. The separating sleeve 17 has a groove 59, which is open in downward direction, so that the separating sleeve 17 can, with the control sleeve being shifted in right-hand direction, be shifted over the foot 60 of the control sleeve comprising the protrusion 18. In this position as shown in FIG. 14, the pin 55 engages the slot 56. Subsequently, the control sleeve is again shifted into the central position, in which the protrusion 18 now engages the anular groove segment 57. Thereafter the separating sleeve is rotated into the position shown in FIG. 13.

Figure 3:
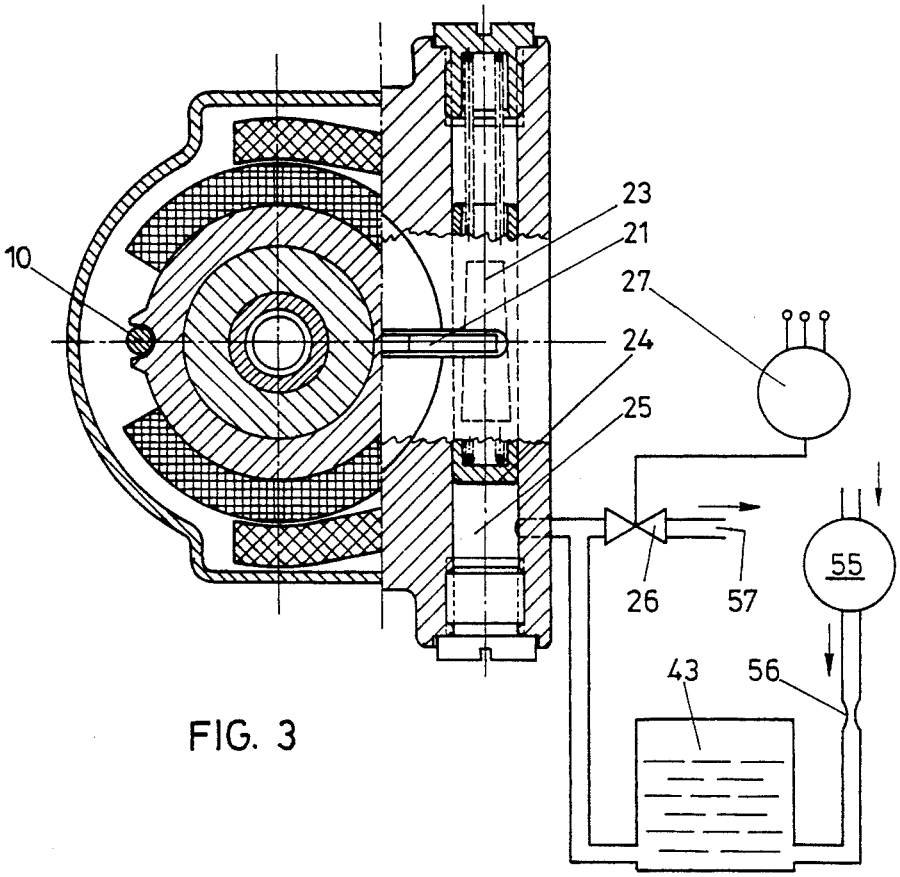
Figure 4:
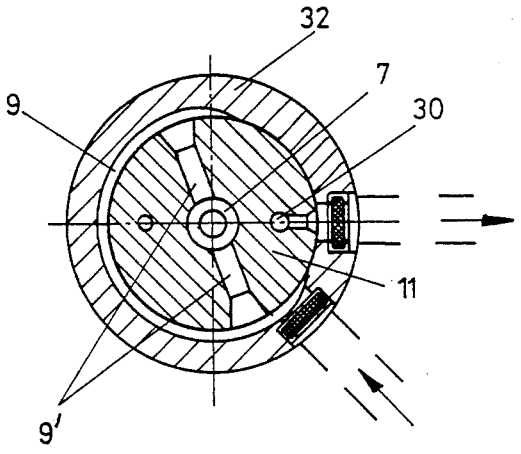

As is shown in FIG. 1, the separating sleeve 17 has at its upper end a hook-like protrusion 21 sensing with its hook arm 22 a surface 23 extending in transverse relation to the pump axis and being slightly inclined relative to a plane normal to the pump axis and being shiftable in parallel relation to this normal plane. By shifting this surface 23, the hook-like protrusion 21 is lifted or lowered and the control sleeve 12 is adjusted in axial direction of the pump piston on account of the interpositioned separating sleeve 17, so that the beginning of fuel injection is varied. Shifting of the inclined surface 23 is effected by means of a hydraulic piston 24. As is shown in FIG. 3 shifting of the hydraulic piston 24 is caused by a fuel pressure or the like in the working chamber 25, which pressure is adjusted in a pressure-controlled chamber 43. The chamber 43 is subjected to the action of pressurized fluid, in particular fuel, via a pressure generator 55 and a throttle 56, which pressurized fluid may flow in a controlled manner via the valve 26, controlled by an electronic regulator 27, into a return conduit 57. In this manner, the pressure in the pressure-controlled chamber 43 and with this in the working chamber 25 of the hydraulic piston 24 may be adjusted in dependence of operating parameters of the engine. By this controlled pressure the inclined surface 23 can be shifted and the control sleeve 12 can be lifted and lowered via the hook-like portion 21 and the separating sleeve 17 and the begin of fuel injection can be varied in correspondence with operating parameters of the motor. The pressure generator 55 need not be a separate pump, because the pressure required for the mentioned purpose can be taken from a chamber of the pump nozzle comprising fuel and can, for example, be provided by the existing fuel supply pump (forepump).

Figure 5:
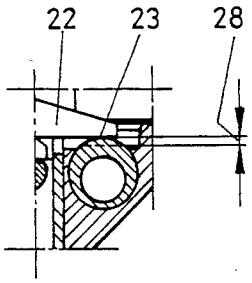
FIG. 5 shows a detail.

The inclined surface 23 being sensed by the hook-like portion 21 may be comparatively long in the direction of its inclination. The stroke of the control sleeve 12 for adjusting the begin of the fuel injection is very small. Thus, there may be obtained a considerable transmission ratio between the shifting path of the inclined surface 23 and the stroke of the control sleeve 12, so that the sensitivity of the control is substantially improved. In FIG. 5 there is shown in detail the inclined surface 23 being sensed by the hook-like portion 21. The gradient of this inclined surface is indicated by 28. It can be seen, that the gradient is very small when compared with the sensed length of this surface.

The fuel discharge chamber comprising the control sleeve is designated by 29. In this discharge chamber are also positioned the compression springs 19. The discharged fuel is supplied from the fuel discharge chamber 9 via bores 30 into the return conduit, and this separate from the suction chamber, so that the pressure within the suction chamber 9 is not adversely influenced by the discharged fuel and a tranquilized pressure is at disposal for suction purposes. When fuel necessary for the working chamber 25 for the piston 24 shifting the inclined surface is taken from the suction chamber 9 pressure fluctuations within the suction chamber can become effective till the inclined surface 23 being sensed by the hook-like protrusion 21 and can thus again influence the setting of the beginning of fuel injection. On account of the fact, that the discharged fuel does not flow into the suction chamber, the precision of controlling the beginning of fuel injection is increased. 31 is the pump spring chamber, which is surrounded by the housing 32 of the pump nozzle. Oil leaking into this pump spring chamber can also be discharged via a return conduit.

Figure 6:
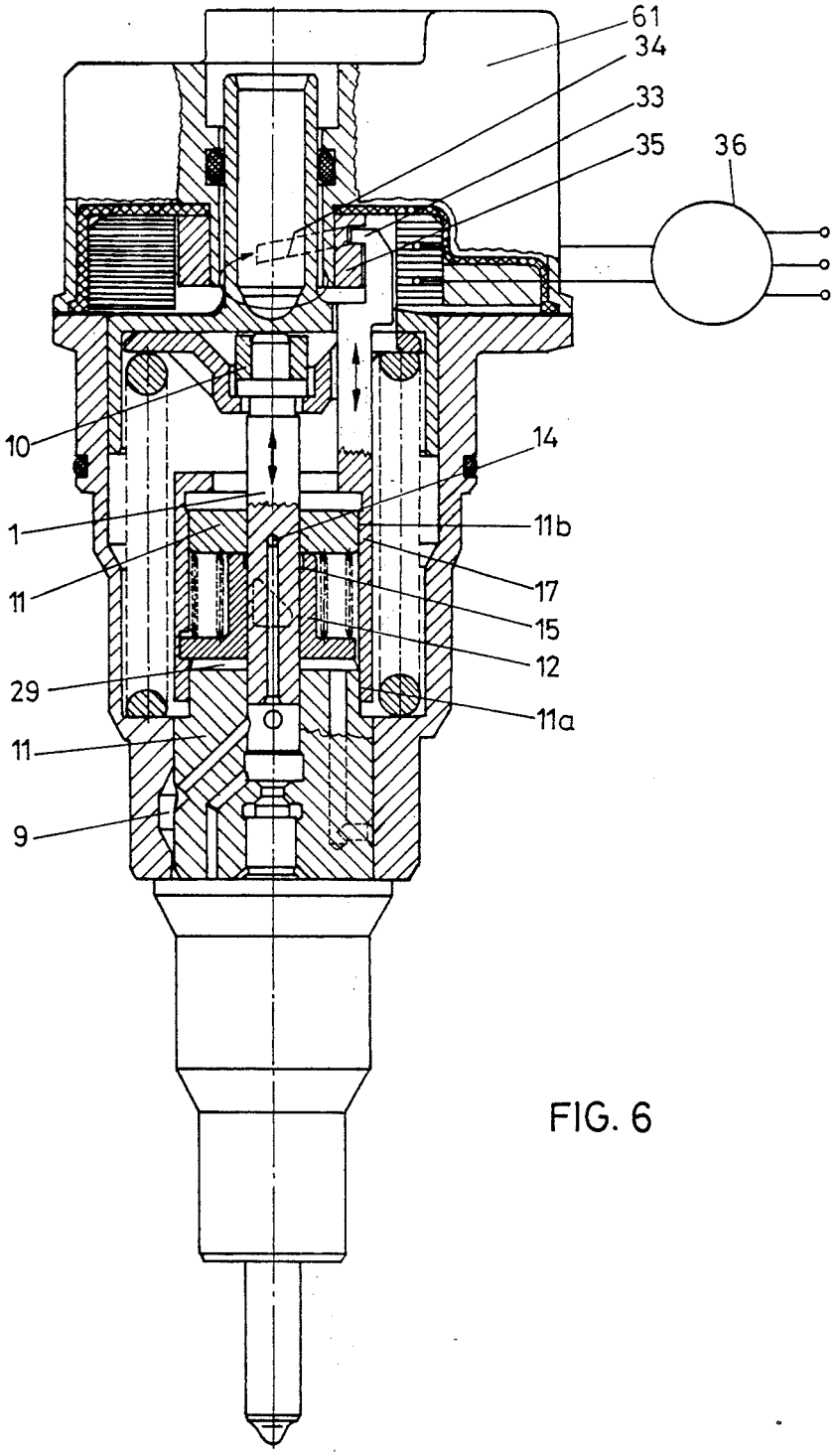
FIG. 6 shows a modified embodiment in a representation similar to that of FIG. 1.

In the arrangement according to FIG. 6, the hook-like portion 33 extends from the separating sleeve 17 upwardly in vertical direction and engages a helical groove within the mantle of the rotor 35 of an electrical control member, the lower boundary 34 formed like a helix of said groove forming the race representing the inclined surface. Also this race 34 may be subdivided into different sections having inclinations of varying degree and/or of varying direction. 36 is an electronical regulator for the electric control member. In the housing 61 there is also provided a control member (not shown) for rotating the pump piston 1.

Figure 7:
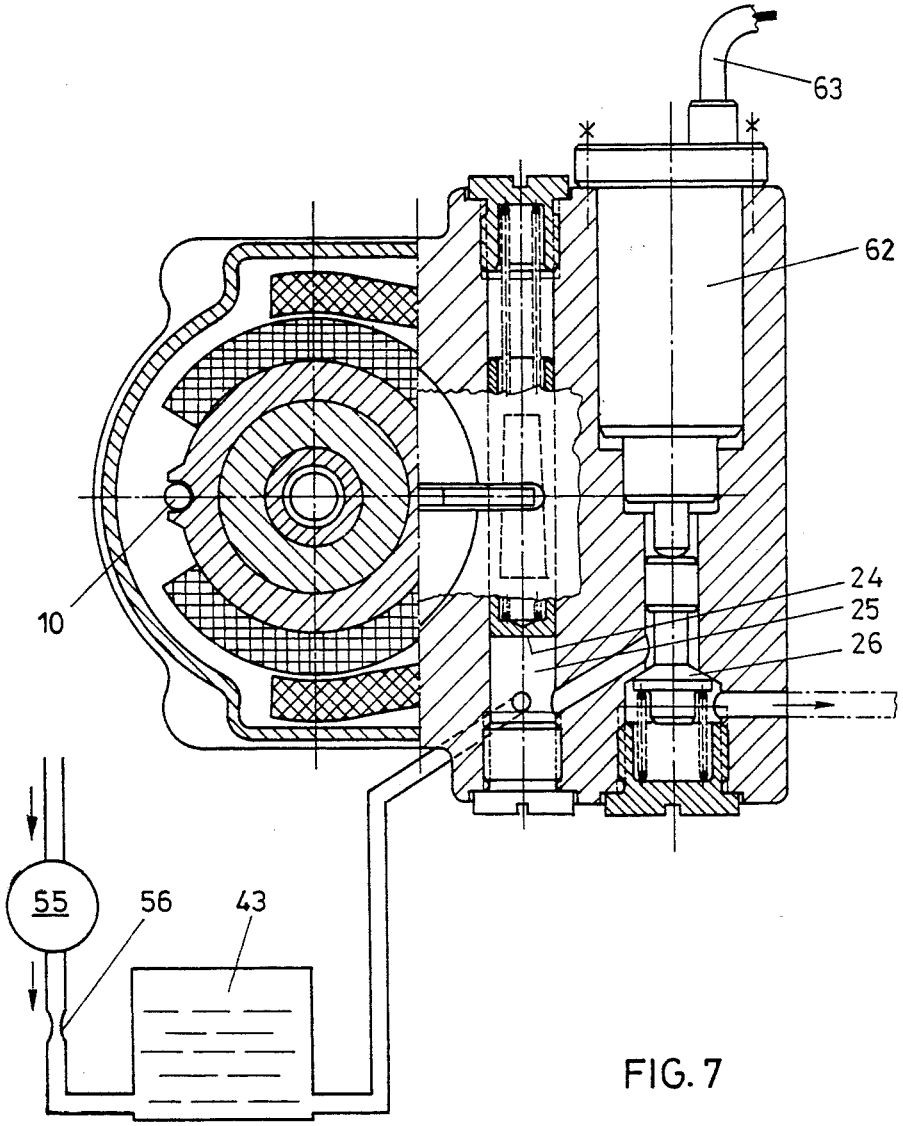
FIG 7 shows a horizontal partial section through a modified pump nozzle comprising a switching valve incorporated into the housing of the pump nozzle.

FIG. 7 shows in a section analog to FIG. 3 an example in which the electronically controlled switching valve 26 is housed within the housing of the pump nozzle. 62 is an electromagnet acting on the switching valve 26, which magnet is controlled by an electronic control unit or regulator 27, as is shown in FIG. 3. 63 is the line connecting the electromagnet 62 with the electronic control unit 27.

Figure 8:
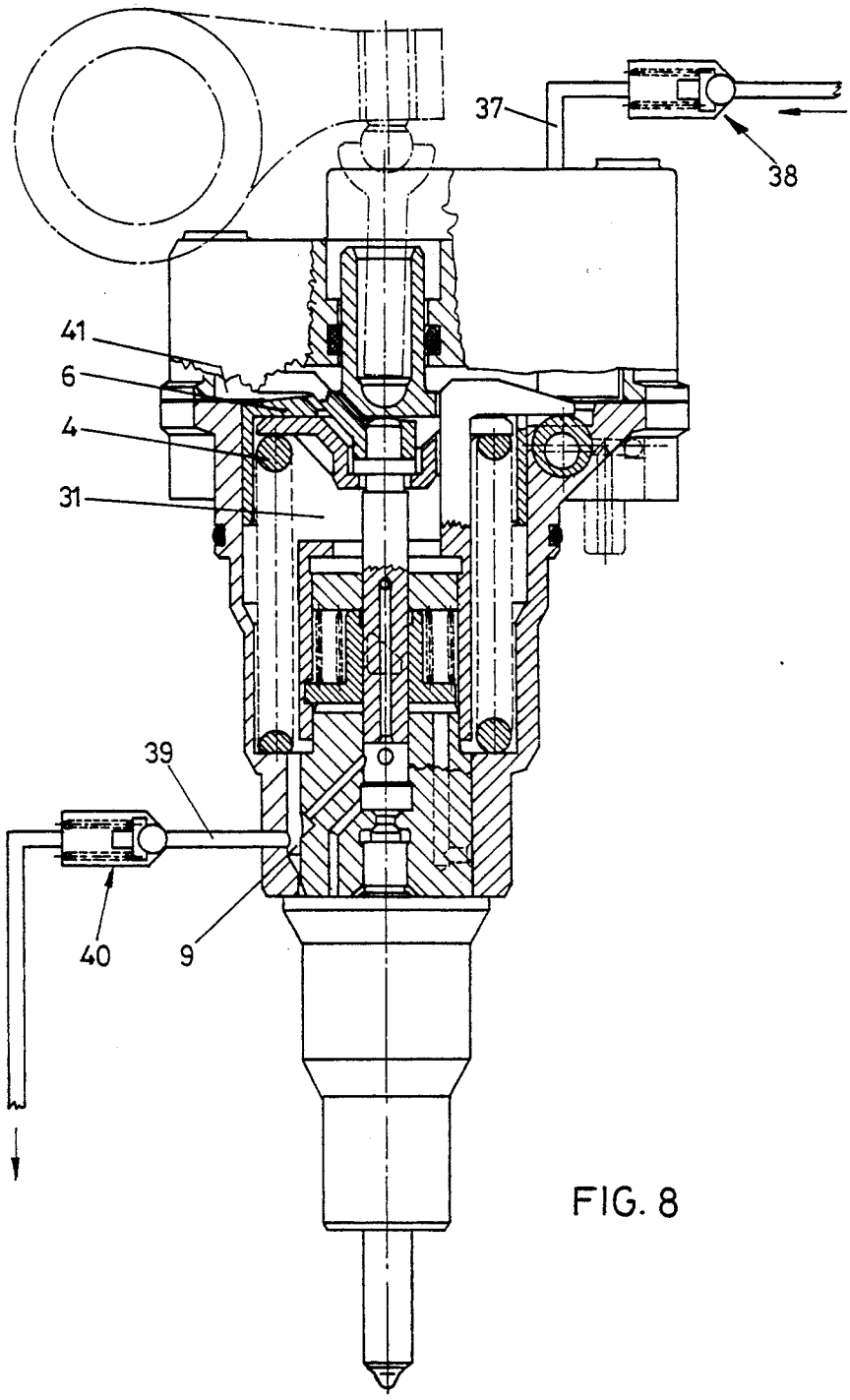
FIG. 8 shows in an axial section a modified embodiment of a pump nozzle, in which fuel is supplied to the suction chamber via the pump spring chamber.

FIG. 8 shows a modified embodiment in which the fuel is supplied to the suction chamber 9 via a chamber 41 housing the electrical control member actuating the crank lever for rotating the pump piston and via the pump spring chamber 31. A check valve 38 is interconnected into the supply conduit 37 and a pressure keeping valve 40 is interconnected into the discharge conduit 39. During the working stroke of the pum the guide bushing 6 of the pump spring 4 produces a certain pumping action, through which the pressure of the fuel supplied by the forepump is increased.

Figure 9:
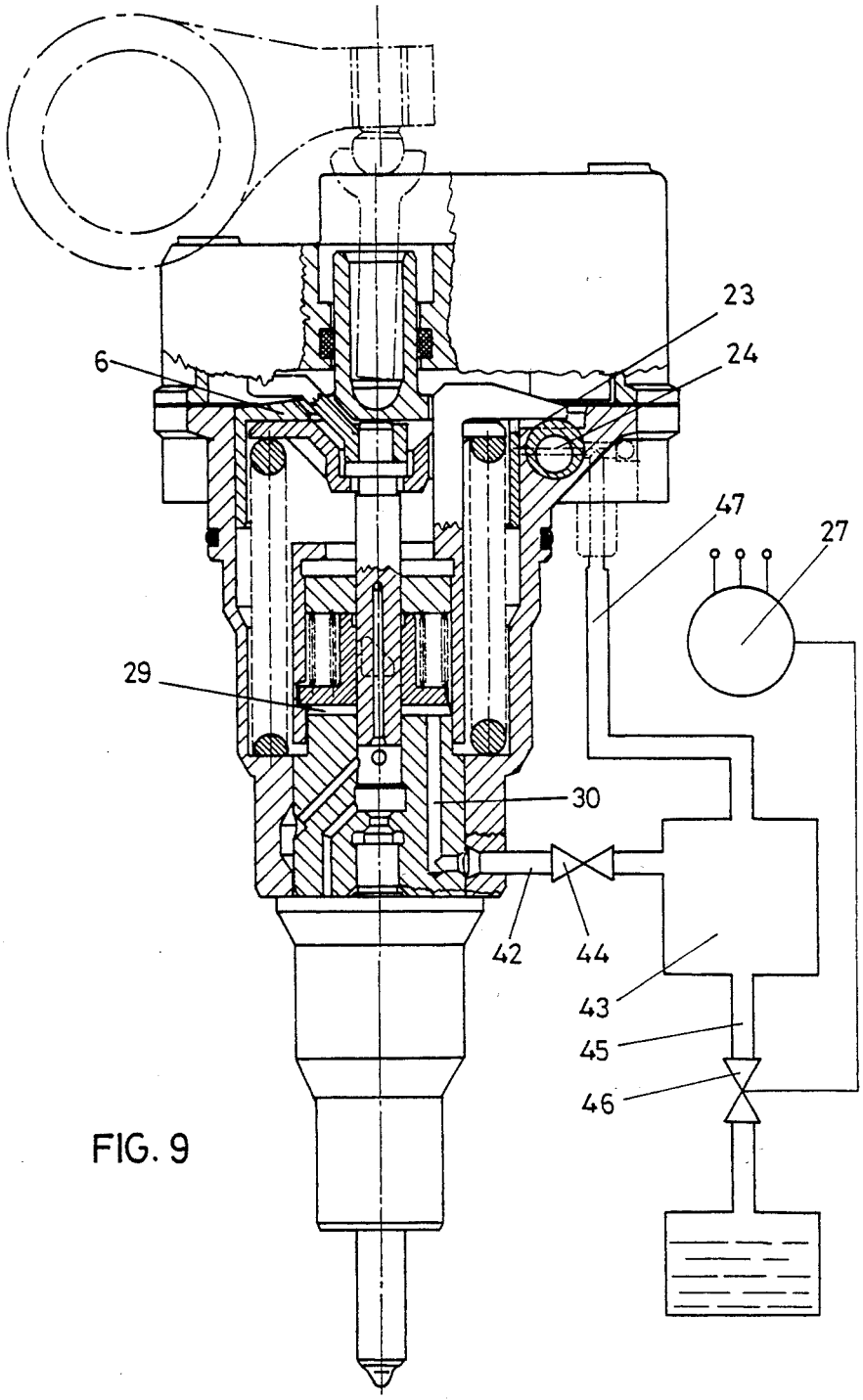
FIG. 9 shows in an axial section a modified embodiment, in which fuel is supplied to the pressure-controlled chamber from the fuel return chamber.

The embodiment according to FIG. 9 shows an example utilizing the pressure of the discharge fuel. The discharged fuel is supplied from the fuel discharge chamber 29 and via the bore 30 and a conduit 42 into the pressure-controlled chamber 43. A throttle cross-section or a throttle valve 44 is interconnected into the conduit 42. A switching valve 46 controlled by an electronic regulator 27 is interconnected into a discharge conduit 45, so that the pressure within the chamber 43 can be adjusted in correspondence with operating parameters of the motor. The fuel pressure having been adjusted in this manner is made effective on the hydraulic piston 24 from the chamber 43 via a conduit 47.

Figure 10:
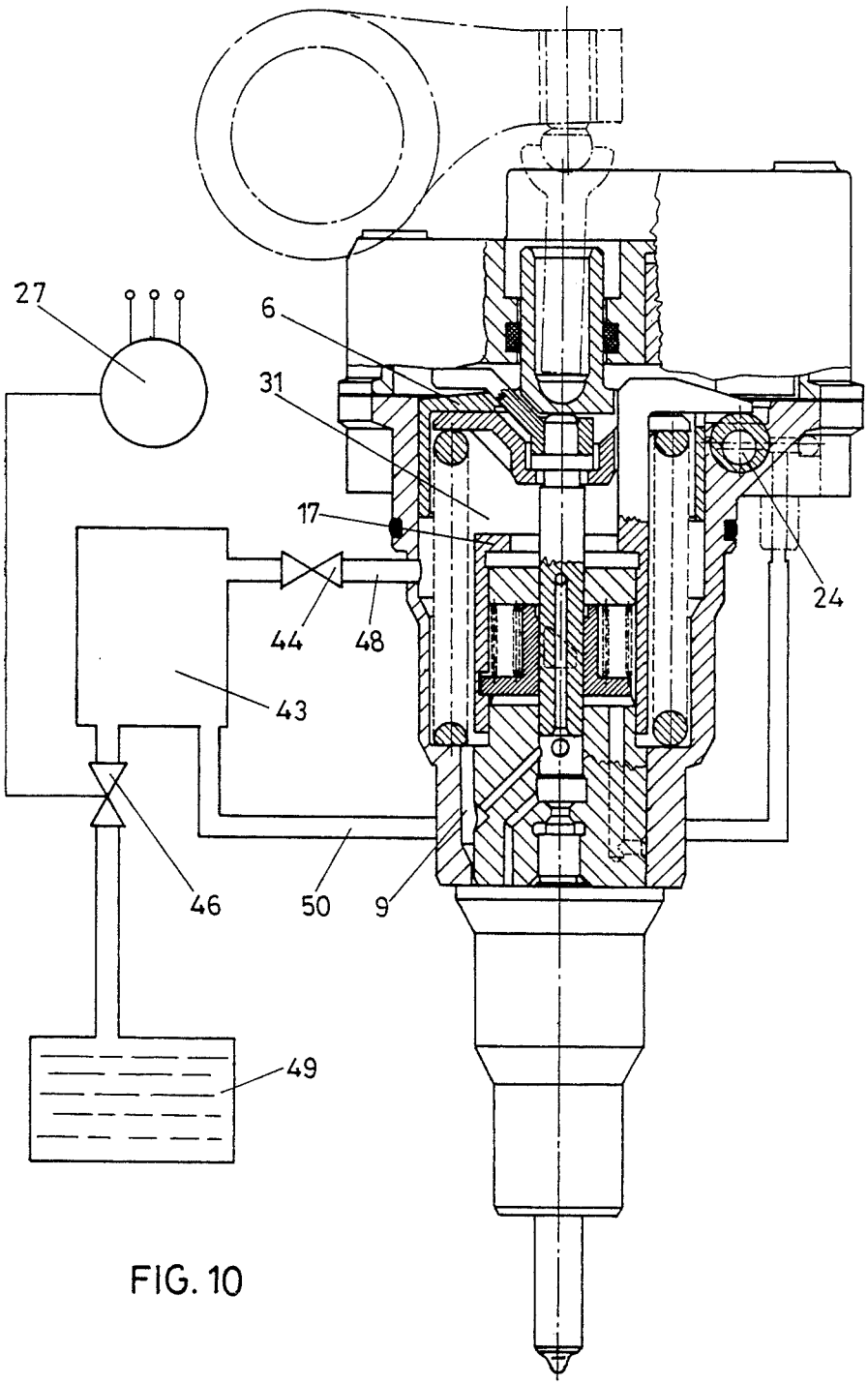
FIG. 10 shows an embodiment, in which the fuel is supplied from the pump spring chamber into the pressure-controlled chamber located outside of the pump nozzle.

In FIG. 10 there is shown a modified embodiment, in which the pressure derived from the pump spring chamber 31 is utilized for actuating the hydraulic piston. The pressure-controlled chamber 43 is connected with the pump spring chamber 31 through a conduit 48 via a throttle valve 44. A switching valve 46 being controlled by the electronic regulator 27 controls fuel discharge to the reservoir 49 and thus the pressure within the pressure-controled chamber 43. The pressure derived from the pressure-controlled chamber 43 becomes effective on the hydraulic piston 24 via a conduit 50. The pump spring chamber 31 is in connection with the suction chamber 9 as in the embodiment of FIG. 8. Through a conduit (not shown) fuel is transported into the suction chamber 9 or into the pump spring chamber by the forepump (not shown).

Figure 11:
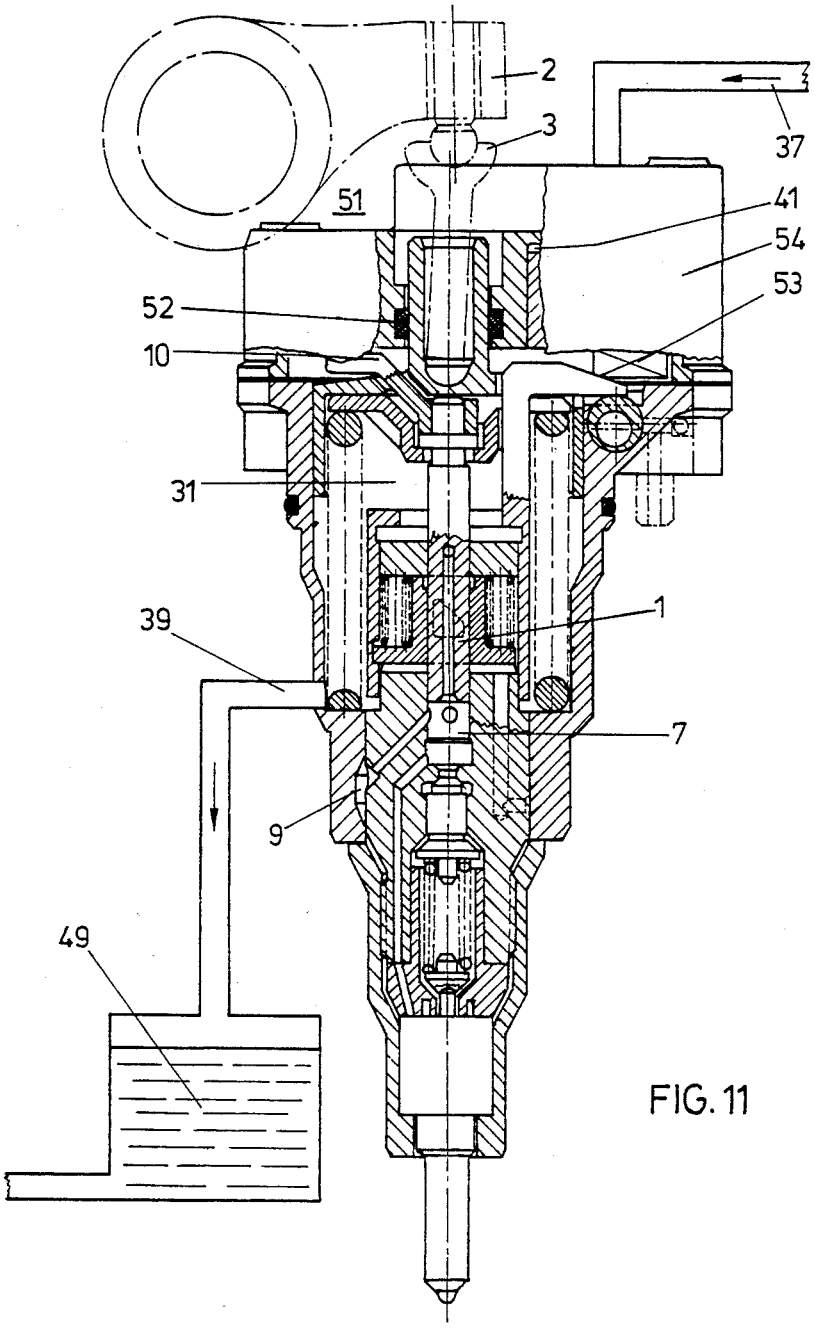
FIG. 11 shows a further modified embodiment in an axial section corresponding to the representation of FIG. 1.

In the embodiment according to FIG. 11, the chamber 41 housing the electrical control member 54 for actuating the crank lever 10 for rotating the pump piston 1 and the pump spring chamber 31 being in unobstructed connection with that chamber 41 are flown through by fuel not used for the injection and being supplied via a fuel supply conduit 37 and discharged into the reservoir 49 via a fuel return conduit 39. In this manner, a cooling of the electrical coil 53 of the control chamber, positioned in the housing 54, for rotating the pump piston is effected and fuel leaking from the high pressure chamber 7 into the pump spring chamber 31 is discharged. The chambers 31 and 41 are sealed by means of a sealing 52 against the chamber 51 housing the cam shaft, rocking levers 2 and push rods 3 for the pump drive means, in which chamber 51 motor oil for lubricating the mentioned parts is present.

What is claimed is:

1. Pump nozzle for Diesel engines, in which an injection pump element comprising a pump piston (1) driven by a cam-shaft and a pump element bushing (11) is combined with an injection nozzle (8) to a unit to be associated to one motor cylinder each, wherein the pump piston (1) is surrounded by a control sleeve (12) being non-rotatable relative to the pump element bushing (11) and being adjustable in the direction of the axis of the pump piston (1) in dependence on operating parameters of the motor for the purpose of varying the beginning of injection and wherein the pump piston (1) can be rotated relative to the control sleeve (12) for the purpose of adjusting the supplied amount of fuel, characterized in that the control sleeve (12) is connected with a separating sleeve (17) surrounding the control sleeve and being non-rotatable and non-shiftable in axial direction relative to the control sleeve, said separating sleeve (17) being at both ends of the control sleeve (12) guided for being with its inner side axially shiftable on guiding surfaces (11*a*, 11*b*) of the pump element bushing (11), wherein the pump element bushing (11) includes a space (29) between the guiding surfaces (11*a*, 11*b*) for receiving the control sleeve (12), which space also forms the fuel discharge chamber, in that the separating sleeve (17) has at its end located opposite the injection nozzle (8) a hook-like protrusion (21, 22, 33) sensing a surface (23, 34) transversely extending to the axis and being at least partially inclined relative to a plane normal to the axis of the pump piston (1) and being shiftable in parallel relation to said normal plane in the direction of its inclination, and in that an adjusting force provoking the axial adjusting movement of the control sleeve (12) acts on said inclined surface (23).

2. Pump nozzle as claimed in claim 1, characterized in that the inclined surface (23) is located above the control sleeve (12), is shiftable along a straight line and the shifting direction extends tangentially to a circle concentric to the axis of the pump piston (1).

3. Pump nozzle as claimed in claim 1, characterized in that the inclined surface (23) is in a manner known per se shiftable by means of a hydraulic piston (24).

4. Pump nozzle as claimed in claim 1, characterized in that the inclined surface (23) is formed on the hydraulic piston (24) itself.

5. Pump nozzle as claimed in claim 1, characterized in that the inclined surface is formed of a helical race (34) surrounding concentrically the axis of the pump piston (1) and being rotatable in shifting direction around the axis of the pump piston (1).

6. Pump nozzle as claimed in claim 5, characterized in that the race (34) forming the inclined surface is worked on part of the circumference of the mantle of the rotor (35) or an electric control member.

7. Pump nozzle as claimed in claim 1, characterized in that the inclined surface (23, 34) has sections of differently great inclinations and/or of inclinations of different directions, said sections being arranged one behind the other in shifting direction.

8. Pump nozzle as claimed in claim 1, characterized in that the inclined surface (23) includes with the normal plane an angle of 3° to 22°.

9. Pump nozzle as claimed in claim 1, characterized in that the control sleeve (11) is supported against the supporting surface (20) of the separating sleeve (17) and is pressed against the supporting surface (20) by at least one compression spring (19) being supported against that end of the pump element bushing (11) which is located opposite the injection nozzle (8).

10. Pump nozzle as claimed in claim 9, characterized in that the compression spring (19) is located within the fuel discharge chamber (29).

11. Pump nozzle as claimed in claim 1, characterized in that the fuel discharge chamber (29) is separated from the suction chamber (9) and is connected with the return conduit via bores (30).

12. Pump nozzle as claimed in claim 1, characterized in that the suction chamber (9) is in connection with the pump spring chamber (31) and the fuel supply to the suction chamber (9) is passed via the pump spring chamber (31), wherein one check valve (38, 40) is arranged in the fuel supply conduit (37) to the pump spring chamber (31) as well as in the fuel return conduit (39) coming from the suction chamber (9).

13. Pump nozzle as claimed in claim 1, characterized in that the hydraulic piston (24) is subjected to the action of fuel from a pressure-controlled chamber (43), in which the pressure is controlled in dependence on operating parameters of the motor, for example by means of a valve (46) controlled by an electronic control unit (27).

14. Pump nozzle as claimed in claim 13, characterized in that fuel is supplied to the pressure-controlled chamber (43) either from the fuel discharge chamber (29) of the pump nozzle or from the pump spring chamber (31) being connected with the suction chamber (9).

15. Pump nozzle as claimed in claim 14, characterized in that the fuel is supplied to the pressure-controlled chamber (43) via a throttle area or a throttle valve (44).

16. Pump nozzle as claimed in claim 13, characterized in that a switching valve (26) controlled by an electronic control unit for modulating the pressure level for subjecting to pressure the hydraulic piston (24) is incorporated within the housing of the pump nozzle.

17. Pump nozzle as claimed in claim 12, characterized in that the pump spring chamber (31) and a chamber (41) housing an electric control member (54) for actuating a crank lever (10) for rotating the pump piston (1) are in free connection one with the other and are sealed (sealing 52) against the chamber (51) housing the cam shaft, rocking levers (2) and push rods (3) for the pump drive means and in that a fuel supply conduit (37) is connected to the chamber (41) housing the control member (54) and a fuel return conduit (39) to the reservoir (49) is connected to the pump spring chamber (FIG. 11).

* * * * *